US007124464B2

(12) United States Patent
Williams et al.

(10) Patent No.: US 7,124,464 B2
(45) Date of Patent: Oct. 24, 2006

(54) SCRUBBING DEVICE ATTACHABLE TO A MOP

(75) Inventors: Todd A. Williams, 12 Santa Barbara Pl., Laguna Niguel, CA (US) 92677; Paul B. Specht, Willmette, IL (US)

(73) Assignee: Todd A. Williams, Scottsdale, AZ (US)

( * ) Notice: Subject to any disclaimer, the term of this patent is extended or adjusted under 35 U.S.C. 154(b) by 317 days.

(21) Appl. No.: 10/699,199

(22) Filed: Nov. 3, 2003

(65) Prior Publication Data

US 2004/0098820 A1 May 27, 2004

Related U.S. Application Data

(60) Provisional application No. 60/429,220, filed on Nov. 25, 2002.

(51) Int. Cl.
*A47L 13/12* (2006.01)
*B08B 7/00* (2006.01)

(52) U.S. Cl. ..... 15/115; 15/118; 15/246

(58) Field of Classification Search ..... 15/115, 15/246, 106, 111, 114, 118, 121, 112, 117; 134/6, 26, 24

See application file for complete search history.

(56) References Cited

U.S. PATENT DOCUMENTS

| | | | | |
|---|---|---|---|---|
| 257,294 | A | | 5/1882 | Davis |
| 377,955 | A | | 2/1888 | O'Blenus |
| 399,223 | A | | 3/1889 | Varney |
| 512,543 | A | | 1/1894 | Froberg |
| 625,628 | A | | 5/1899 | Wray |
| 701,657 | A | | 6/1902 | Wilson |
| 702,998 | A | | 6/1902 | Randolph |
| 729,581 | A | | 6/1903 | Held |
| 732,743 | A | | 7/1903 | Held |
| 798,532 | A | | 8/1905 | Sanders |
| 937,007 | A | | 10/1909 | McLaughlin |
| 981,756 | A | | 1/1911 | Glancey |
| 1,067,570 | A | | 7/1913 | Ziegler |
| 1,171,161 | A | | 2/1916 | Wingender |
| 1,171,768 | A | | 2/1916 | Browning |
| 1,221,606 | A | | 4/1917 | Sadler |
| 1,331,477 | A | | 2/1920 | Albin |
| 1,563,829 | A | | 12/1925 | Brown |
| 1,576,777 | A | | 3/1926 | Moore |
| 1,589,253 | A | | 6/1926 | Smiechewicz |
| 1,643,878 | A | | 9/1927 | Crouch |
| 1,748,202 | A | | 2/1930 | Bloomfield |
| 1,760,614 | A | | 5/1930 | Weintraub |
| 2,065,407 | A | | 12/1936 | Steuernagel |
| 2,133,148 | A | * | 10/1938 | Paul ..... 15/115 |
| 2,196,365 | A | * | 4/1940 | Schulman ..... 15/153 |
| 2,518,765 | A | | 8/1950 | Ecker |
| 2,568,218 | A | | 9/1951 | Campbell |
| 2,637,867 | A | | 5/1953 | Kalinowski |
| 2,641,787 | A | | 6/1953 | Vosbikian et al. |

(Continued)

FOREIGN PATENT DOCUMENTS

| | | |
|---|---|---|
| CA | 737140 | 6/1966 |

(Continued)

*Primary Examiner*—Gladys JP Corcoran
*Assistant Examiner*—S Balsis
(74) *Attorney, Agent, or Firm*—William W. Haefliger

(57) ABSTRACT

A method of providing a mop with surface scrubbing capability, that includes providing a surface scrubbing attachment device, and attaching the device to the mop for scrubbing presentation to the surface.

31 Claims, 10 Drawing Sheets

U.S. PATENT DOCUMENTS

| | | | | |
|---|---|---|---|---|
| 2,678,458 | A | | 5/1954 | Vosbikian et al. |
| 2,683,886 | A | | 7/1954 | Neumann |
| 2,691,788 | A | | 10/1954 | Thomasson |
| 2,701,888 | A | | 2/1955 | Vosbikian et al. |
| 2,712,144 | A | | 7/1955 | Dunn |
| 2,988,766 | A | | 6/1961 | Anderson et al. |
| 3,157,901 | A | | 11/1964 | Murphy |
| 3,167,798 | A | | 2/1965 | Dryden |
| 3,906,580 | A | | 9/1975 | Smith et al. |
| 3,964,121 | A | | 6/1976 | Kim |
| 4,802,782 | A | | 2/1989 | Scalf |
| 4,928,342 | A | | 5/1990 | Friedman et al. |
| D358,487 | S | | 5/1995 | Kneesch et al. |
| 5,435,852 | A | | 7/1995 | Robinson |
| 5,522,110 | A | | 6/1996 | Borofsky |
| 5,584,091 | A | | 12/1996 | Borofsky |
| 5,661,866 | A | | 9/1997 | Cameron |
| 5,724,696 | A | | 3/1998 | Di Giammarino |
| 5,903,948 | A | | 5/1999 | Williams et al. |
| 5,918,340 | A | | 7/1999 | Young |
| 5,940,924 | A | * | 8/1999 | Williams et al. ..... 15/115 |
| 5,964,005 | A | | 10/1999 | Williams et al. |
| 6,085,377 | A | | 7/2000 | Williams et al. |
| 6,105,193 | A | | 8/2000 | Williams et al. |
| 6,353,960 | B1 | * | 3/2002 | Jannicelli, Jr. ..... 15/246 |

FOREIGN PATENT DOCUMENTS

| | | |
|---|---|---|
| FR | 1309326 | 5/1961 |
| GB | 155174 | 5/1920 |
| NO | 43062 | 11/1924 |

* cited by examiner

SCRUBBING DEVICE ATTACHABLE TO A MOP

This application claims priority from provisional application Ser. No. 60/429,220 filed Nov. 25, 2002.

BACKGROUND OF THE INVENTION

This invention relates generally to surface scrubbing and mopping, and more particularly to provision of an attachment easily connectable to a mop, to facilitate surface scrubbing.

There is need for improvements in surface scrubbing and mopping whereby the two operations are enabled by one hand manipulable apparatus, such as an elongated mop handle. In particular there is need for an attachment that carries surface scrubbing elements, and which can easily and rapidly be connected to a mop, and preferably to mops of different configurations at the locations of mop connections to handles.

SUMMARY OF THE INVENTION

It is a major object of the invention to provide method and apparatus meeting the above need. Basically, the improved apparatus provides a mop with surface scrubbing capability and that includes an attachment for rigid connection to a mop, and which is adapted to carry a surface scrubbing element or elements. As will be seen, the attachment is configured for clamping to the mop, at or near the mop head, as by force exerted by the mop handle.

It is another object to provide an attachment having a flange shaped tongue or plate to be clamped in position between the end of the mop handle and head. One of the following is also typically provided:

i) the tongue defines a hole to pass the handle end, or to pass a projection to which the handle end fits, ii) the tongue has a clampable portion to be clamped in position adjacent the handle and head, iii) the attachment has two holes of different sizes associated with the tongue to selectively register with different sized mop handles.

As will be seen, a foldable adapter in the form of a flap may be provided, one of the holes to be carried by the tongue and the second hole carried by the flap, the holes being of different sizes, the second hole registering with the first hole when the flap is folded. Accordingly, the device can be securely attached to mop handle ends of different sizes that fit the holes of different sizes.

Yet another object is to provide apparatus as referred to which includes a section carrying scrubbing elements, that section having hinged operative connection to the tongue. That connection may also advantageously include a living hinge, molded in position during plastic molding of the attachment, to accommodate and facilitate flap folding. The scrubbing elements may be carried by a pad which has attachment to a plate portion of the section. Scrubbing bristles may be fused in position to the plate portion, or other carrier, as will be seen. The plate portion and pad connection may be one of the following:

$x_1$) a bond, $x_2$) an interfit connection, $x_3$) projections, and apertures receiving the projections, the projections located on one of the plate and pad, and the apertures located in the other of the plate and pad.

These and other objects and advantages of the invention, as well as the details of an illustrative embodiment, will be more fully understood from the following specification and drawings, in which:

DRAWING DESCRIPTION

Figure 17:
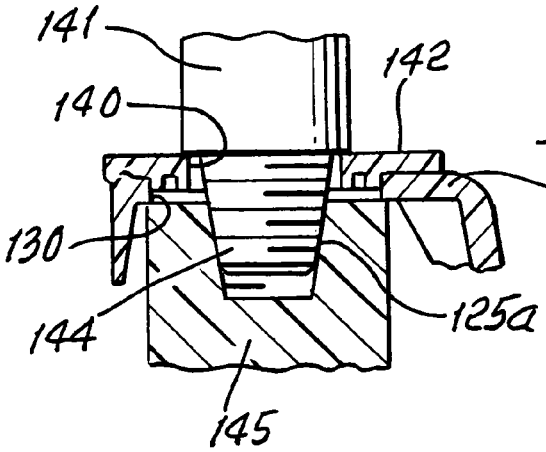
Figure 17A:
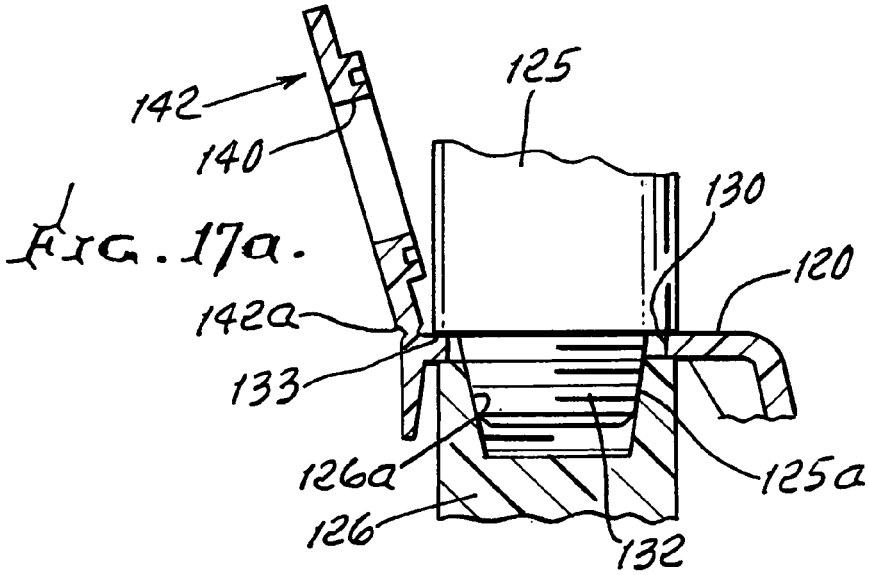
Figure 18:
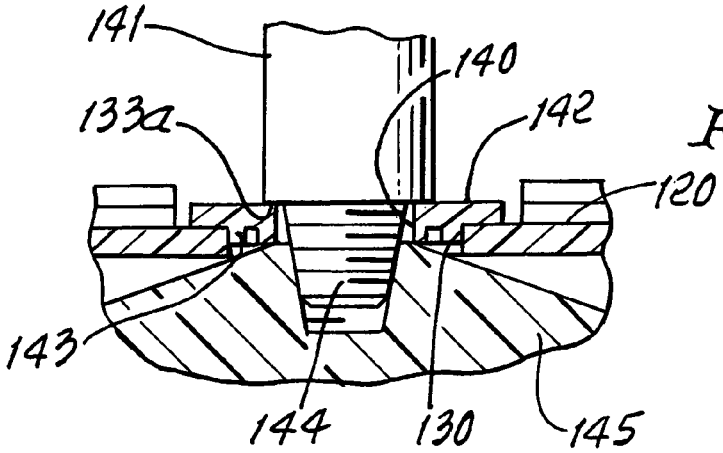

FIGS. 17 and 17*a* are schematic views showing registration of flap and tongue openings of different sizes to accommodate different mop handles;

FIG. 18 is a frontal view of elements as seen in FIG. 17; and

Figure 19:
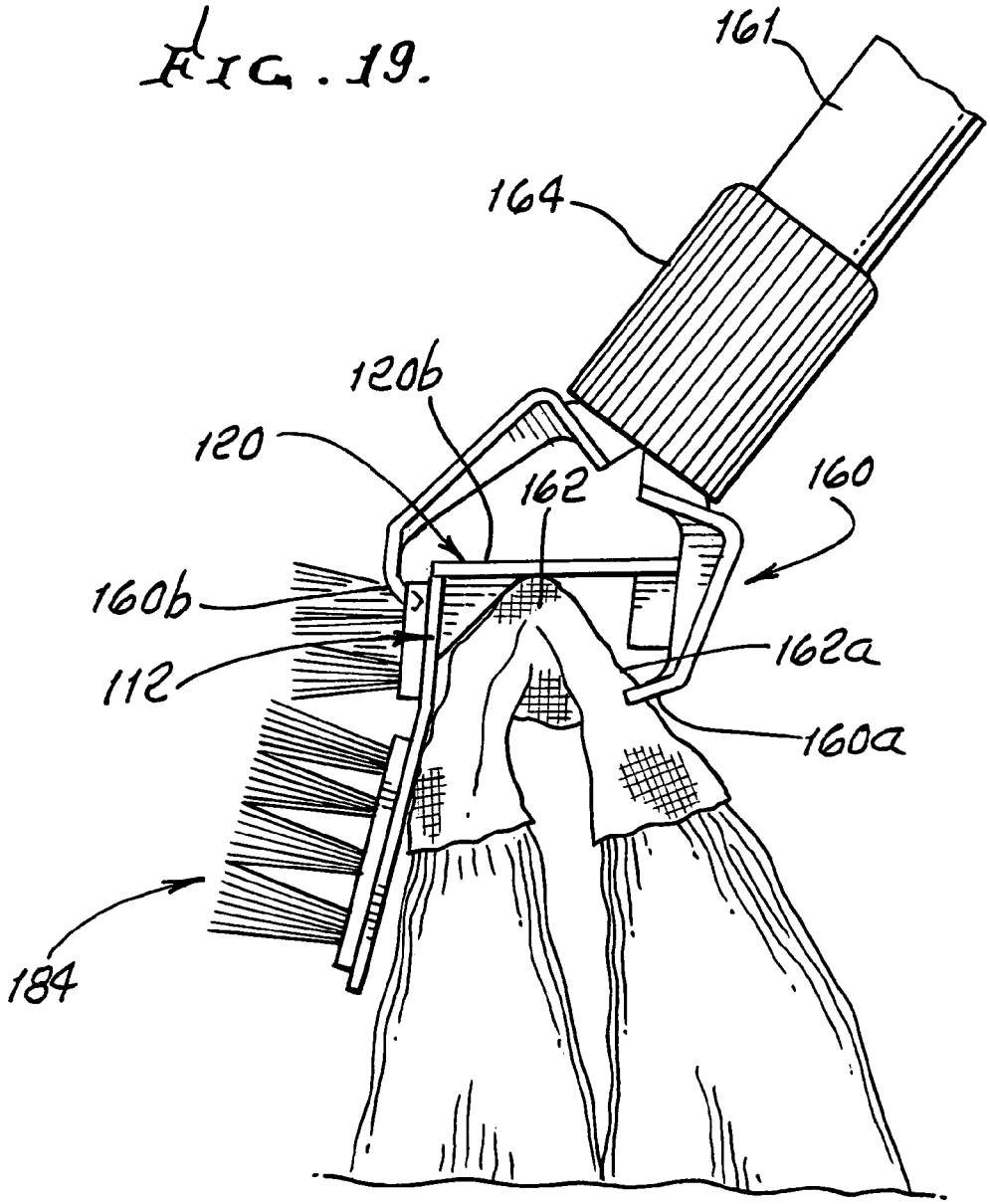

FIG. 19 is an end view of a modified mop handle connection to attachment apparatus of the general type seen in FIGS. 1 and 9–11.

DETAILED DESCRIPTION

Figure 1:
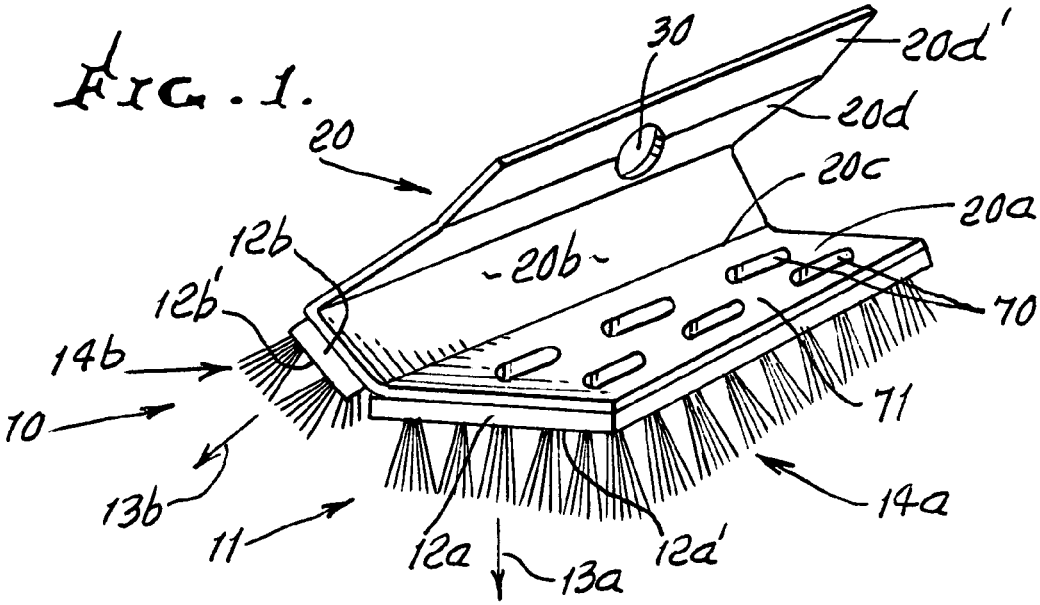
FIG. 1 is a perspective view of apparatus incorporating the invention.
Figure 2:
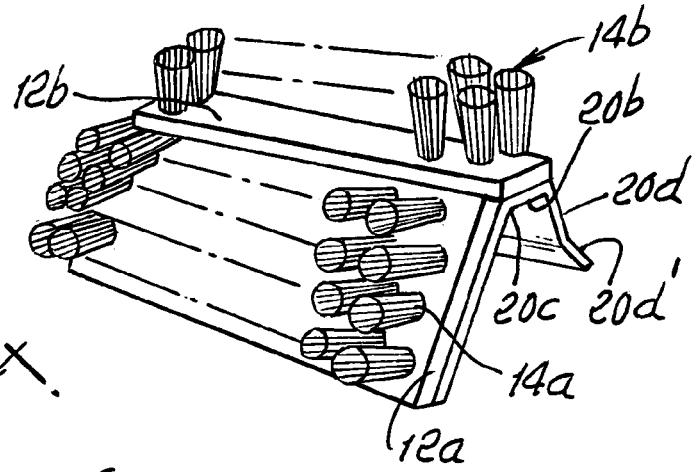
FIG. 2 is an inverted perspective view of the FIG. 1 apparatus.
Figure 3:
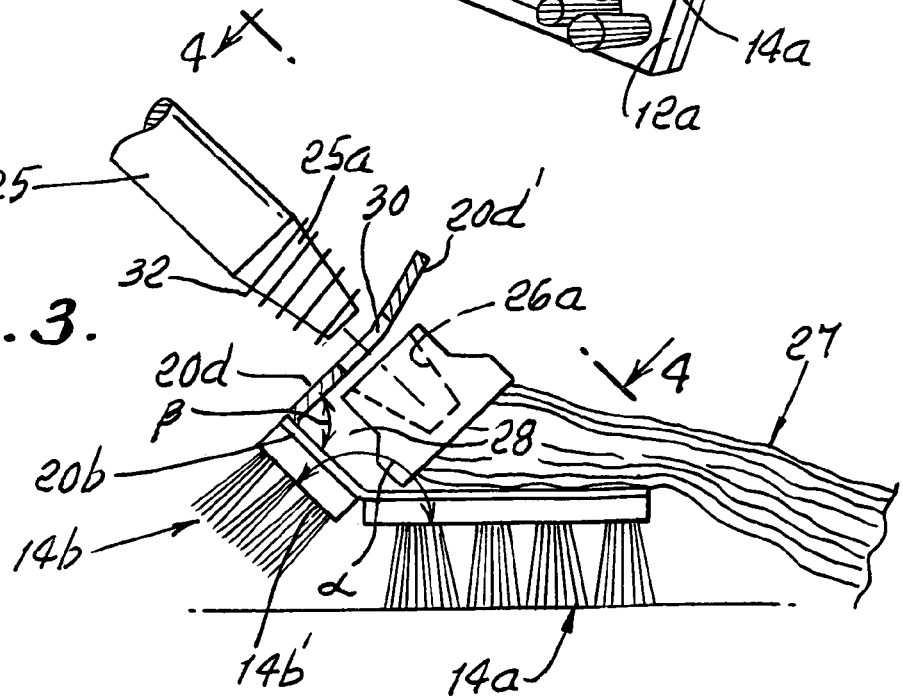
FIG. 3 is an end elevation of the FIG. 1 apparatus.

FIG. 1 is a perspective view showing apparatus 10 for providing a mop with surface scrubbing capability. It includes a surface scrubbing device 11 having an attachment 20 for rigid connection to a mop. Device 11 includes a base 12 having a first section 12*a* with a surface 12*a*' facing in a first direction 13*a*, and a second section 12*b* with a surface 12*b*' facing in a second direction 13*b*, those surfaces 12*a* and 12*b* relatively angled at an obtuse angle α as seen in FIG. 3. Floor scrubbing elements, as for example bristle groups 14*a* and 14*b* are carried to project from surfaces 12*a*' and 12*b*', as shown. FIG. 2 is another perspective view of the apparatus 10 with projecting bristle groups 14*a* and 14*b*.

Attachment 20 includes a plate or plate sections attached to the base 12. See plate section 20*a* attached to base section 12*a*, and plate section 20*b* attached to base section 12*b*. Sections 20*a* and 12*a* may be of one-piece construction, and sections 20*b* and 12*b* may be of one-piece construction. A first fold 20*c* connects sections 20*a* and 20*b*. The attachment includes a tongue as at 20*d* projecting at an angle β from section 20*b* at a fold connection 20*d* to section 20*b*. Angle β may typically be about 90°. The tongue 20*d* typically has an angled extension 20*d*'. The plate and tongue may be integral, and non-metallic. The tongue 20*d*, by itself or with extension 20*d*' are adapted to be clamped between a mop handle and a mop head. See for example the handle 25 and the mop head 26 in the end view of the apparatus 10 in FIG. 3. The mop is shown to include mop strands 27 carried by the head which extend adjacent to the base 12. Head 26 is positioned or captivated in a corner zone 28 formed by one or both plate sections 20*b* and 20*d*.

The tongue has a through opening or hole 30 through which the handle end, or the mop head is received, to establish the connection of the handle to the head. As shown in FIG. 3, the handle 25 has a tapered end portion 25*a* which carries threads 32, and sized to at least in part project through hole 30 and screw into an interiorly threaded recess 26*a* in the mop head 26. In this process, the elements are sized so that the tongue becomes clamped or locked in position adjacent or between the mop head and the handle. The tongue 20*d*, base sections 20*a* and 20*b*, handle 25, and mop head 26 are thereby easily assembled into an interlocked unit, for floor scrubbing and/or mopping. Scrubbing may be carried out as in FIG. 3 position, with bristle group 14*a* engaging the floor surface 35, or in FIG. 8 position, with bristles 14*b* engaging the floor surface. The bristle ends may be fused to the base sections, or otherwise connected to those sections. See bristle supporting portions 14*a*' and 14*b*'.

Figure 4:
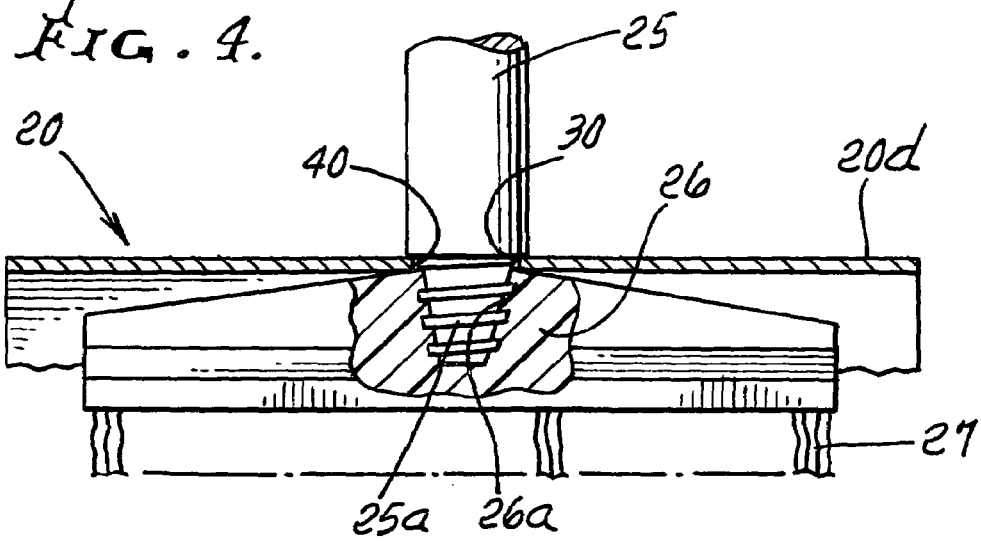
FIG. 4 is a view taken on lines 4—4 of FIG. 3.

FIG. 4 shows the completed assembly of elements referred to above, in FIGS. 1–3. Note the clamping at 40 of the attachment 20, between the mop head 26 and the handle end. The attachment can be quickly attached to the mop, as by unscrewing handle 25 from mop head 26, inserting the handle end 25*a* through hole 30 in the tongue, and then tightening the handle end 25*a* into the head recess 26*a*.

Figure 5:
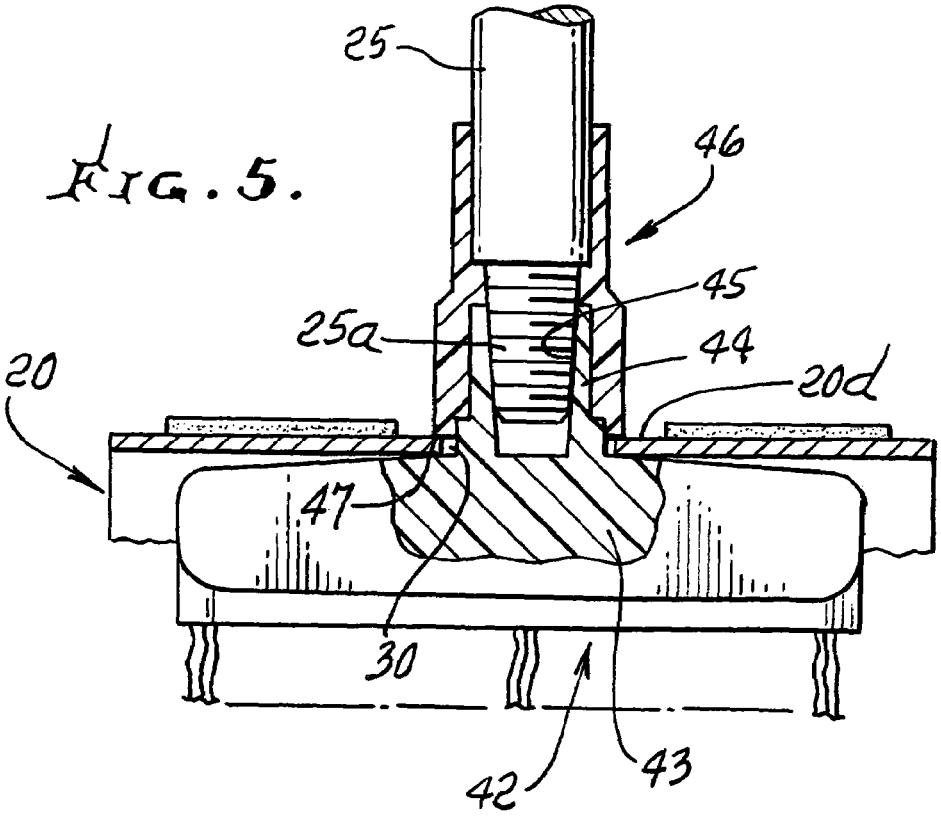
FIG. 5 is a view like FIG. 4 but showing connection of the apparatus to another type mop.

FIG. 5 shows the attachment 20 connected to another type mop 42. The mop head 43 carries a projecting sleeve 44 that is inserted through hole 30 in 20*d*. The sleeve is internally threaded at 45 to receive the threaded end 25*a* of the handle 25. Upon tightening, a clamping sleeve 46 is urged downwardly by the handle to telescopically fit about sleeve 44 and to clamp at 47 against tongue 20*d*, to rigidly hold the attachment 20 to the mop head 43.

Figure 7:
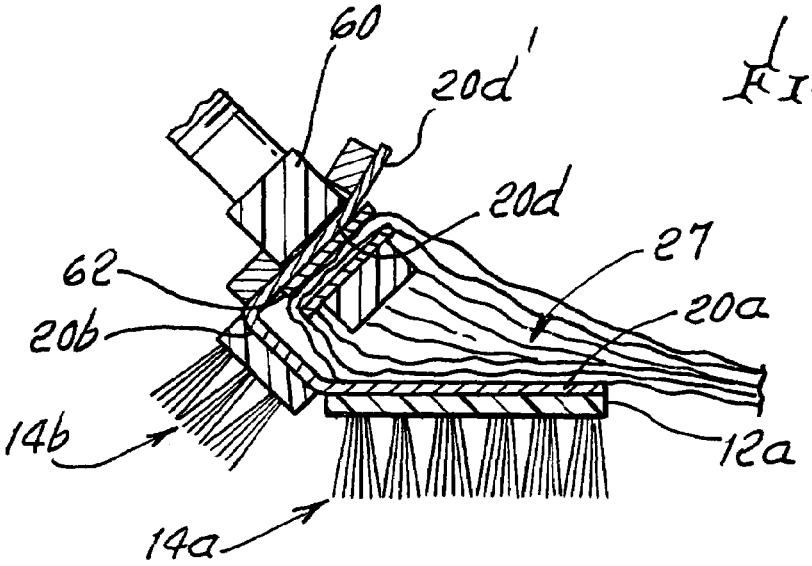
FIG. 7 is a section taken on lines 7—7 of FIG. 6.
Figure 6:
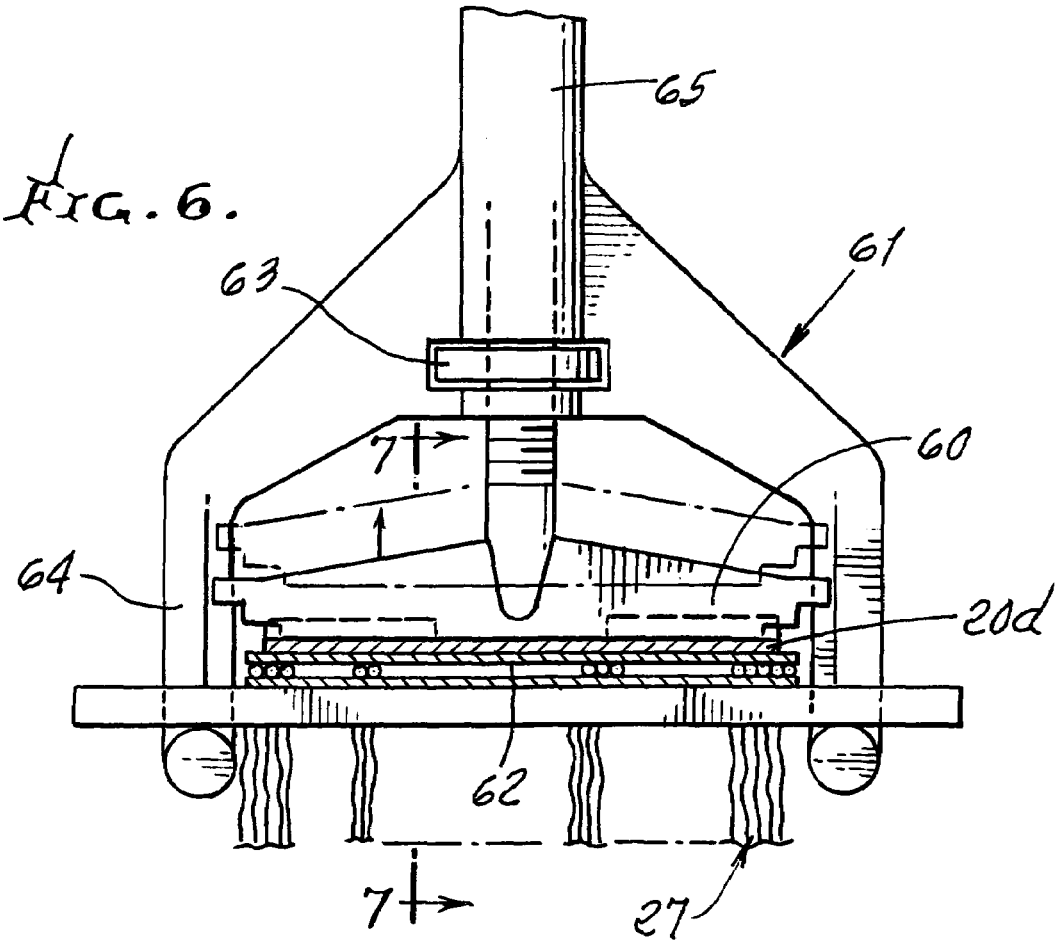
FIG. 6 is a view like FIG. 5, but showing connection of the apparatus to yet another type mop.

In FIGS. 6 and 7, the tongue 20*d* of the attachment 20 is clamped between a traveling bar 60 of the mop 61, and mop fixed structure 62. A thumb screw 63 advances and retracts bar 60. The mop includes a frame 64 and a handle 65.

Water slots as seen at 70 in FIG. 1 may be used to drain water.

Figure 8:
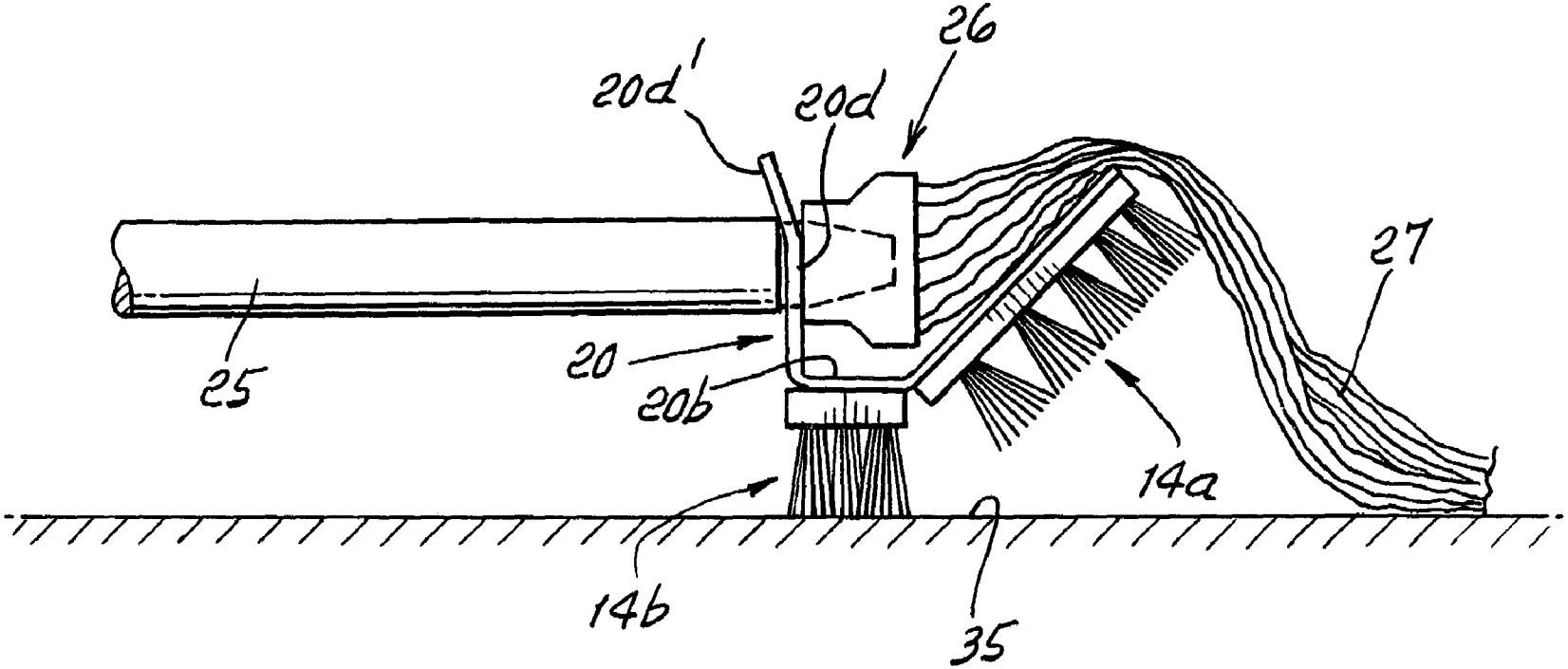
FIG. 8 is an end view of the FIG. 1 type apparatus in tilted position for floor scrubbing.

FIG. 8 shows the FIG. 1 apparatus 10 in tilted position for floor scrubbing by bristle group 14*b* engagement with surface 35. Note handle 25 extending substantially horizontally. Plate section 20*b* also extends substantially horizontally. Mop strands 27 also engage the surface 35.

FIGS. 9–16 show a modified attachment apparatus 100 for providing a mop with surface scrubbing capability. Apparatus 100 facilitates connection of a mop 101 to a mop handle 125; and a surface scrubbing device 110 is attached to, or attachable to, the apparatus 100. See FIG. 14.

Figure 11:
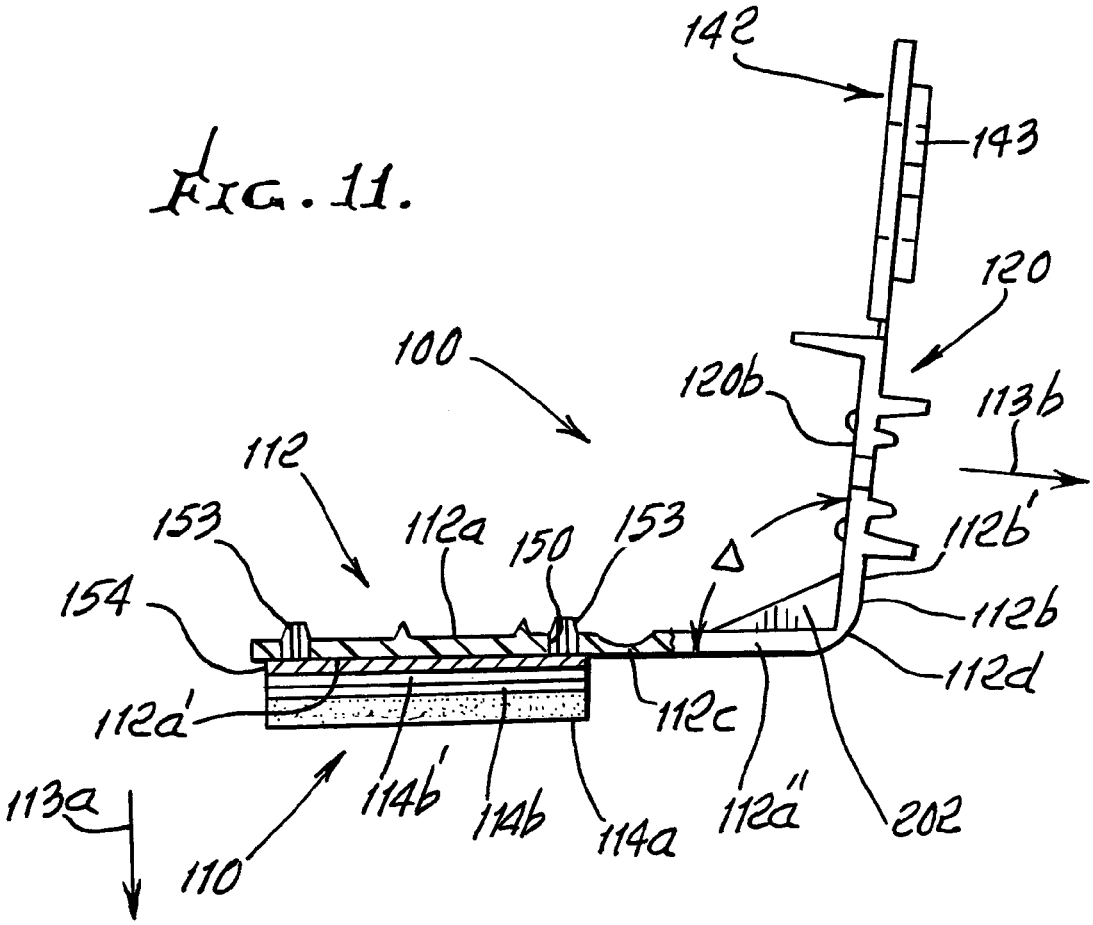
FIG. 11 is an end elevation of the FIGS. 9 and 10 apparatus, and also showing scrubbing pad attachment to a plate section of that apparatus.

As seen in FIG. 11, device 110 includes a base 112 in the form of a plate, having a first section 112*a* with a surface 112*a*' facing in direction 113*a*; and a second section 112*b* with a surface 112*b*' facing in a second direction 113*b*. Surfaces 112*a*' and 112*b*' are relatively angled at an obtuse angle Δ as seen in FIG. 11. A floor scrubbing element, as for example scrub pad 114*a* is carried by section 112*a* to project away from surface 112*a*', as seen in FIG. 11. Pad 114*a* may be attached by VELCRO layer or layers 114*b* and 114*b*' to a plate 154, which is in turn attached via projections 153 to 112. See openings 150. Pad 114*a* may for example be a pad produced by Glit/Microtron, a Katy Company, Item 20967, 20968 or 20969. A reduced thickness living (flexible) hinge may be provided at 112*c*, as by plastic molding, to connect section 112*a* with extension 112*a*" which is connected to 112*b* at corner 112*d*.

Attachment 120 includes a plate or plate section attached to base 112. See plate section 120*b* attached to or integral with 112*b*. Stiffener ribs 202 may be provided to stiffen that corner attachment, fixing angle Δ. Base 112 and plate section 120*b* may be of one-piece, plastic molded construction, whereby plate or plate section 120*b* is well adapted to support or connect to the mop head, and base 112 is well adapted to support or carry a scrubbing pad 114*a*, or scrubbing bristles, as referred to, force being transmitted from the handle to the bristles (during scrubbing) via the plate 120*b* and the base 112, of fixed relative angularity as referred to, stiffeners 202 assisting in fixing that angularity.

Figure 9:
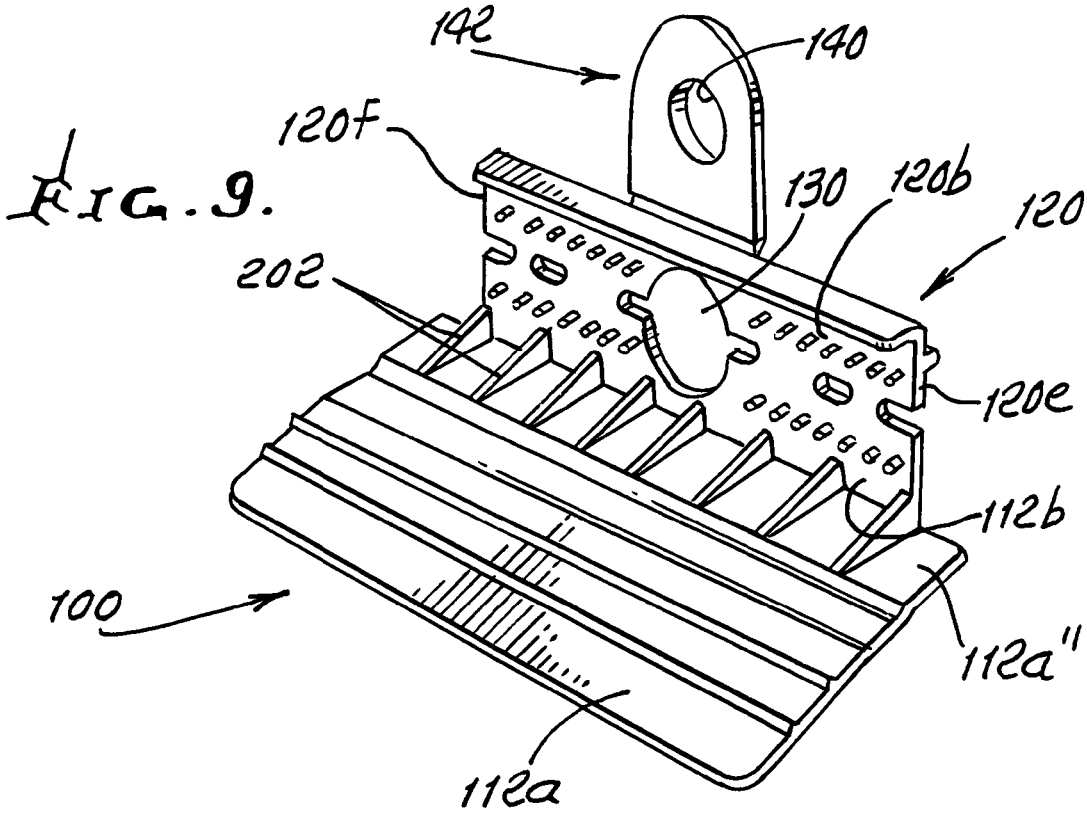
FIG. 9 is a front perspective view of another form of apparatus incorporating the invention, and which is preferred.
Figure 10:
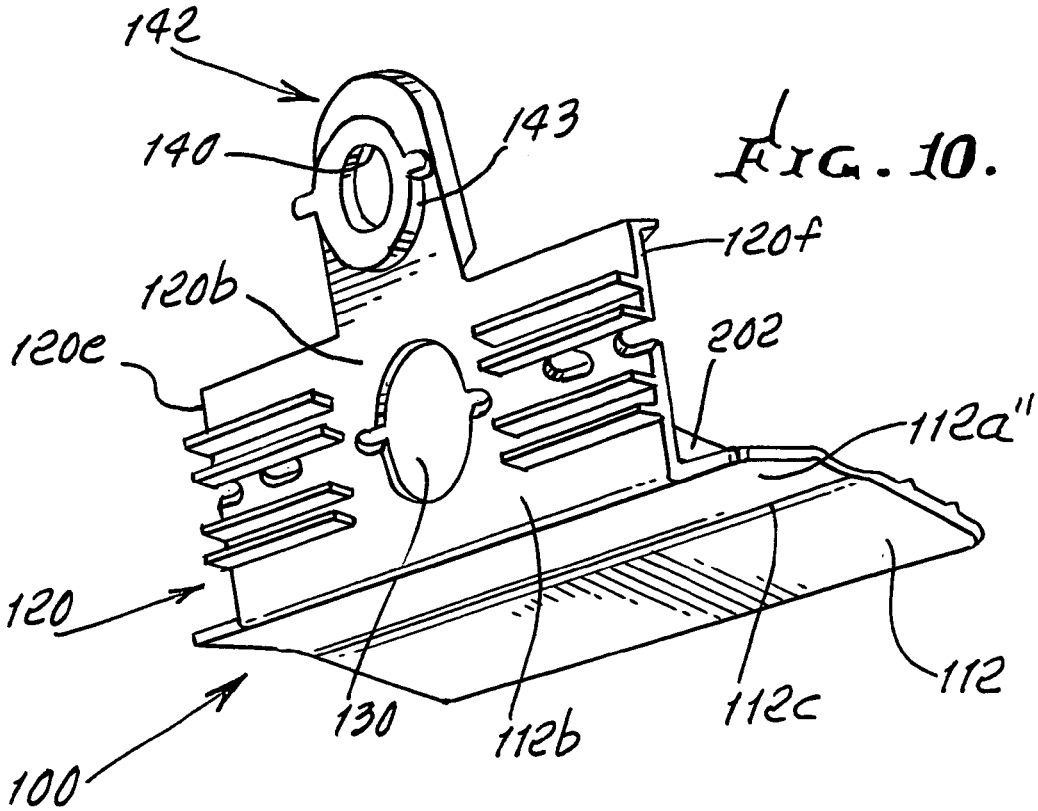
FIG. 10 is a rear perspective view of the FIG. 9 apparatus.

Plate or plate section 120*b* contains a through opening or hole 130 through which the handle end is received to establish connection of the handle 125 to the mop head. See FIGS. 9, 10, and 14. Hole 130 is located about mid-way between opposite ends 120*e* and 120*f* of the rigid plate 120, as seen in FIGS. 9 and 10. The dimension between ends 120*e* and 120*f* is preferably between 1 inch and 15 inches.

FIG. 17*a* shows the handle tapered end portion 125*a*, with threading 132, sized to project through hole 130 and screw into an interiorly threaded recess 126*a* in the mop head 126. The flange or shoulder 133 on the handle clamps the plate 120 to the mop head.

Figure 12:
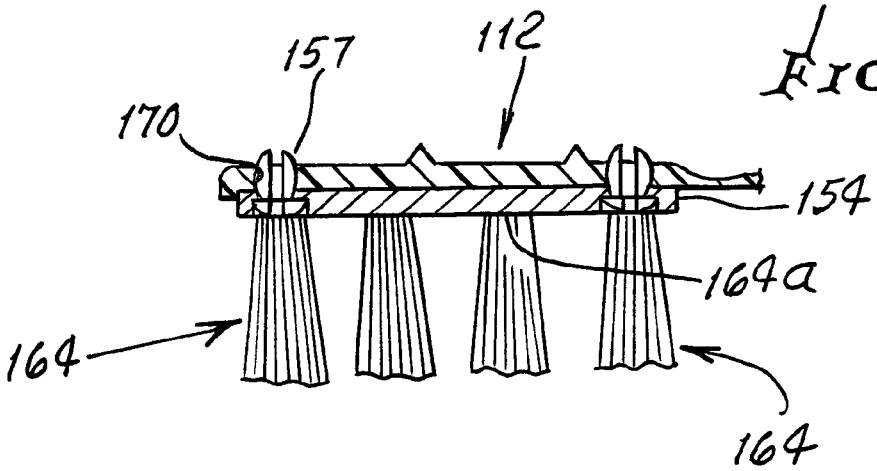
FIG. 12 is a view like FIG. 11, showing another mode of scrubber attachment, the scrubber being bristles.
Figure 14:
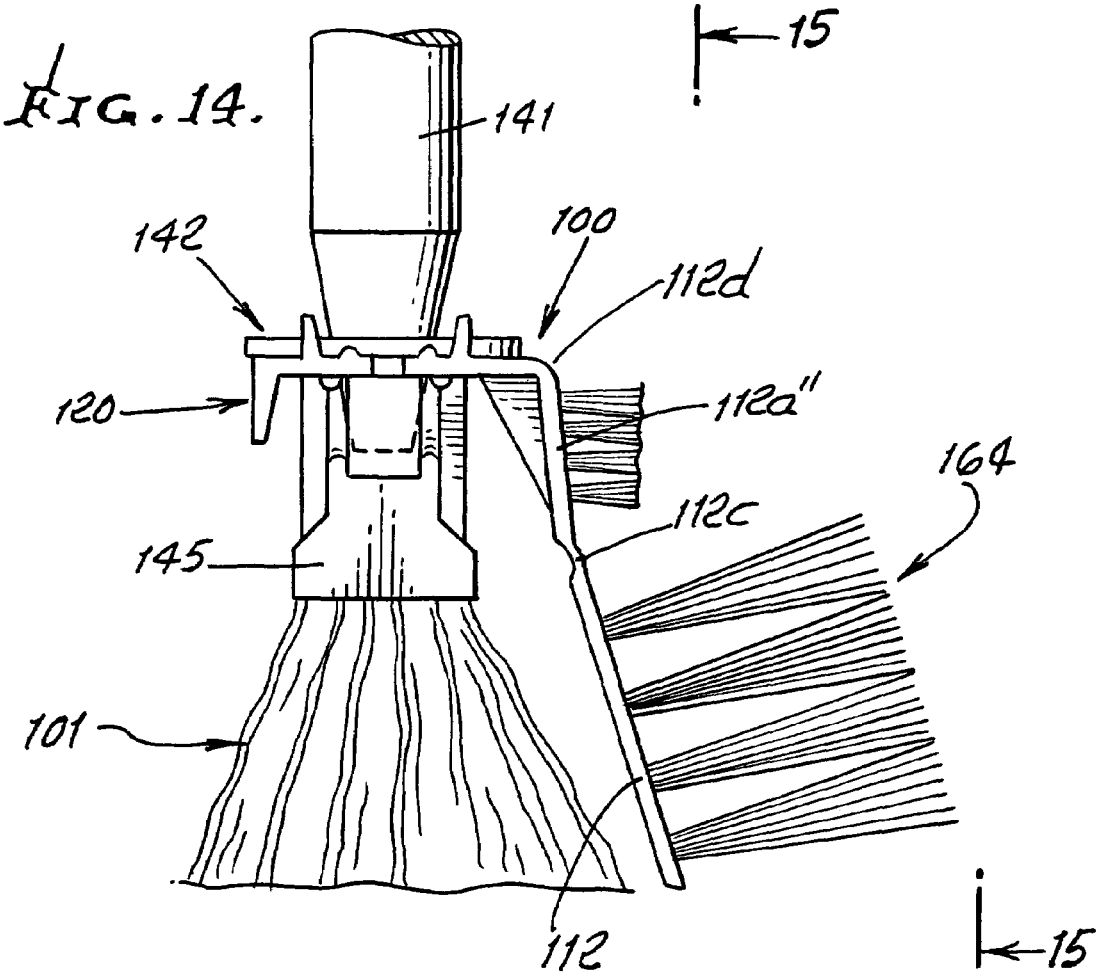
FIG. 14 is an end view showing mop connection to the FIG. 11 device.
Figure 15:
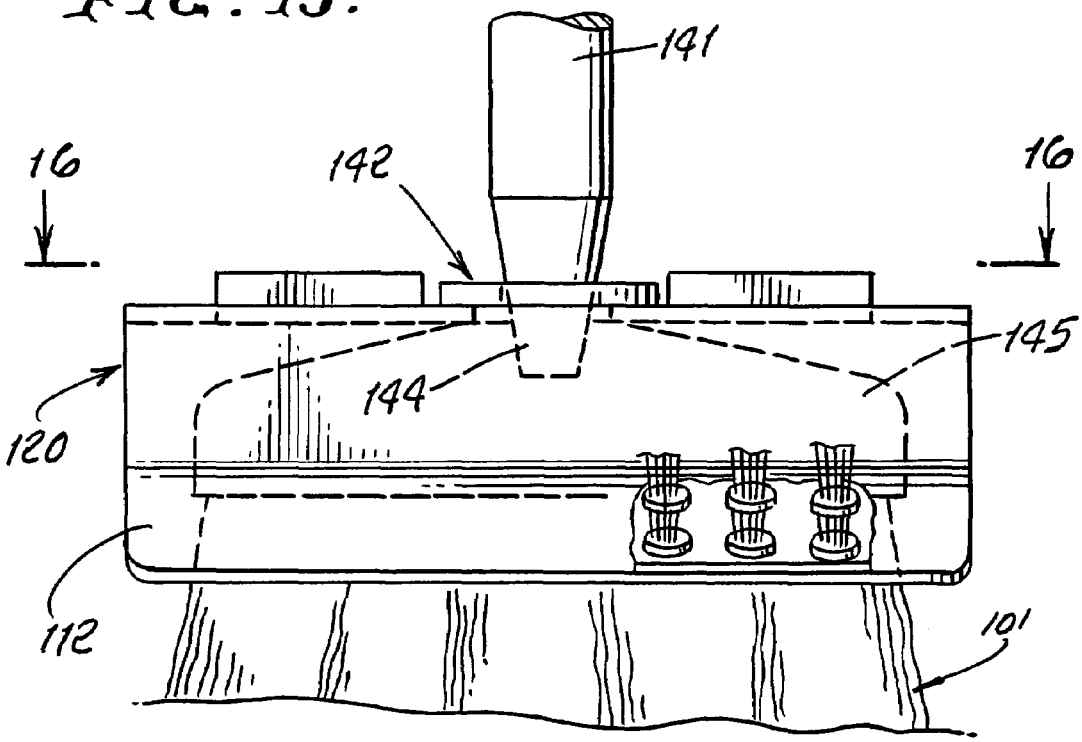
FIG. 15 is a frontal view taken on lines 15—15 of FIG. 14.
Figure 16:
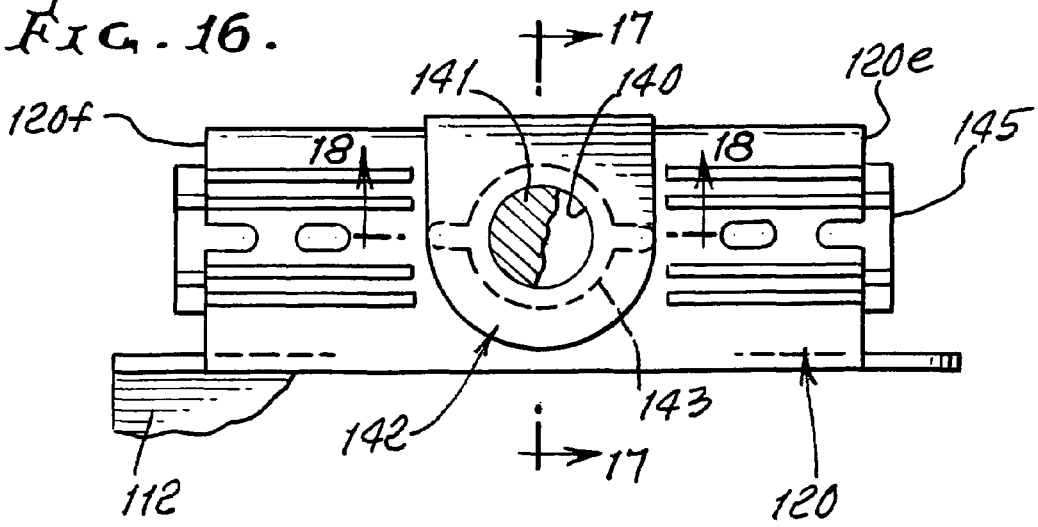
FIG. 16 is a plan view taken on lines 16—16 of FIG. 15.

FIGS. 12 and 14 show bristle groups 164 having ends 164*a* as an alternate scrubbing device. The bristle ends can be fuse connected to 112 and bristles 164 and plate 112 may consist of polypropylene. Bristles can also be carried by extension 112*a*".

In accordance with one important aspect of the invention, two holes of different sizes or diameters are associated with the plate section 120, (or otherwise designated as a form of tongue), to selectively and alternatively register with different size (or diameter) mop handles. A first hole may be the described hole 130 to receive a relatively larger size mop handle end 132; and a second hole such as is shown at 140, is alternatively usable with a second and smaller size mop handle end seen at 141 in FIGS. 17 and 18. Hole 140 is provided as a through hole in an adapter in the form of a flap 142 foldable downwardly into position adjacent plate 120, as seen in FIG. 17.

Hole 140 is of smaller diameter than hole 130, but it comes into coaxial registration with hole 130, as seen in FIG. 18. To assure or assist this flap positioning, an annular boss 143 is provided on the flap, and it fits into hole 130 to center hole 140 relative to hole 130. The mop handle 141 also has reduced diameter threading 144 to screw into the alternate mop head 145, as shown, and a clamp-up relationship is achieved as respects the mop handle, the plate 120 and the mop head. A living hinge 142*a* may be provided to foldably connect the flap 142 to plate section 120*b*. The handle clamps to the flap 142 at 133*a* in FIG. 18. See also FIGS. 15 and 16.

FIG. 11 shows apertures 150 in base 112 to receive projections 153 carried by a plate 154. FIG. 12 shows another form of connection of a bristle plate 154 to base 112, wherein projections 157 extend through apertures 170 in base 112.

FIG. 19 shows an adjustable claw 160 connection of the mop handle 161 to the mop head 162. Claw finger or fingers 160*a* penetrate the mop head at its side 162*a*, and claw finger or fingers 160*b* grip the base 112 of the attachment 120, as shown. A rotor 164 on the handle 161 is rotatable to adjust claw gripping. Bristles 184 are fused to plate section 112.

Figure 13:
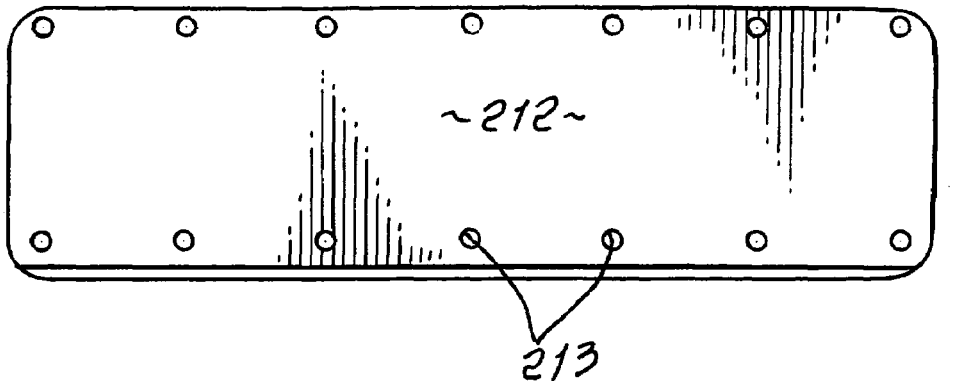
FIG. 13 is a bottom view of the plate section of the apparatus, to which the pad is attachable.

FIG. 13 shows a form of a base 212, like 112, with apertures 213 to receive projections on a bristle carrying plate.

The devices of the invention will also enable normal mop wringing, as by use of a mop bucket wringer, for example of side press or down press type. Such device 100 may consist of molded plastic material to weigh between 1 and 32 ounces.

Further features and elements are listed in the attached claims, and/or shown in the drawings.

We claim:

1. The method of providing a mop with surface scrubbing capability, that includes:

a) providing a surface scrubbing attachment device, and b) attaching said device to the mop for scrubbing presentation to the surface to be scrubbed, c) and wherein the mop has a head and also has a handle, and including manipulating said handle to exert force that clamps the attachment device to the mop at or proximate the mop head, d) and wherein said device is provided in the form of a sheet or sheets that in cross-section define a stiffened bend, wherein a first portion of the sheet defines or carries a floor scrubber, and a second portion of the sheet or sheets defines a tongue extending at an angle to said first portion, the tongue configured to receive said clamping force, the first portion of the sheet configured to extend adjacent mop strands, there being a hinge integral with the first portion of the sheet and located between the stiffened bend and the floor scrubber.

2. The method of claim 1 wherein the tongue is positioned and clamped between the mop handle and mop head.

3. The method of claim 1 wherein one of the following is employed:

i) the tongue defines a hole to pass the handle end, or to pass a projection to which the handle end fits, ii) the tongue has a clampable portion to be positioned for reception of said clamping force.

4. The method of claim 1 wherein said scrubber defines projecting floor scrubbing elements.

5. The method of claim 4 wherein certain of said elements project in a first direction, and other of said elements project in a second direction.

6. The method of claim 5 wherein all of said elements comprise bristles.

7. The method of claim 6 wherein the bristles have supporting portions fused to a base defined by the device.

8. The method of claim 1 including providing said attachment with two holes of different sizes associated with the tongue to selectively register with different mop handles.

9. The method of claim 1 including providing an adapter in association with said attachment, the adapter defining a first through hole, and the tongue defining a second through hole, the holes being of different sizes.

10. The method of claim 9 wherein the adapter is provided in the form of a flap foldable at said hinge which is an elongated living hinge associated with the attachment.

11. Apparatus for providing a mop with surface scrubbing capability, comprising in combination:

a) a surface scrubbing device, b) said device having an attachment for rigid connection to the mop, c) and including said mop which has a head and a handle, said attachment clamped to the mop at or near the mop head, by force exerted via the mop handle, d) and wherein said device has the form of a sheet or sheets that in cross-section define a stiffened bend, whereby a first portion of the sheet defines or carries a floor scrubber, and a second portion of the sheet or sheets defines a tongue extending at an angle to said first portion, the tongue configured to receive said clamping force, the first portion of the sheet configured to extend adjacent mop strands, there being a hinge integral with the first portion of the sheet and located between the stiffened bend and the floor scrubber.

12. The apparatus as defined in claim 11 wherein said attachment is clamped to the mop at or near the mop head, by force exerted via the mop handle.

13. The apparatus of claim 11 wherein one of the following exists:

i) the tongue defines a hole to pass the handle end, or to pass a projection to which the handle end fits, ii) the tongue has a clampable portion to be clamped in position adjacent the handle and head.

14. The apparatus of claim 11 wherein said scrubber includes projecting floor scrubbing elements.

15. The apparatus of claim 14 wherein certain of said elements project in a first direction, and other of said elements project in a second direction.

16. The apparatus of claim 15 wherein all of said elements comprise bristles.

17. The apparatus of claim 16 wherein the bristles have supporting portions fused to a base defined by the device.

18. The apparatus of claim 15 wherein said elements are carried by a base defined by said device, the base having a first surface facing in a first direction, and a second surface facing in a second direction, said surfaces relatively angled at an obtuse angle.

19. The apparatus of claim 11 wherein one of the following exists:

i) there are two holes of different sizes associated with the tongue to selectively register with different mop handles, ii) there is a foldable flap associated with the tongue, and a first hole carried by the tongue and a second hole carried by the flap, the holes being of different sizes, the second hole registering with the first hole when the flap is folded.

20. The apparatus of claim 11 wherein said hinge is a living hinge.

21. The apparatus of claim 20 said scrubber is a pad having a connection to the said first portion of the sheet which is a plate portion, said wherein scrubber is proximate the living hinge to exert downward and bending force thereon.

22. The apparatus of claim 21 wherein the connection is defined by one of the following:

$x_1$) a bond, $x_2$) an interfit connection, $x_3$) projections and apertures receiving the projections, the projections located on one of the pad and plate portion, and the apertures located in the other of the plate portion and tongue.

23. The apparatus of claim 21 wherein said attachment has two holes of different sizes associated with the tongue to selectively register with different mop handles.

24. The apparatus of claim 21 wherein the attachment has an adapter defining a first through hole, and the tongue defining a second through hole, the holes being of different sizes.

25. The apparatus of claim 24 wherein the adapter is a flap foldable at said hinge associated with the attachment.

26. The apparatus of claim 11 wherein said scrubber is a pad having a connection to said first portion of the sheet which is a plate portion, said plate portion, hinge and stiffened bend being generally in the same plane.

27. The apparatus of claim 26 wherein the connection is defined by one of the following:

$x_1$) a bond, $x_2$) an interfit connection, $x_3$) projections and apertures receiving projections, the projections located on one of the pad and plate portion.

28. The apparatus of claim 26 wherein said plate portion is elongated, and has one of the following:

i) length between one inch and fifteen inches, ii) length which is about 7 ¼ inches.

29. Apparatus for providing a mop with surface scrubbing capability, comprising in combination:

a) a surface scrubbing device, b) said device having an attachment for rigid connection to the mop, c) and including said mop which has a head and a handle, said attachment clamped to the mop at or near the mop head, by force exerted via the mop handle, d) the attachment including a tongue clamped in position between the mop handle and the mop head, e) there being a section carrying scrubbing elements, said section having hinged operative connection to said tongue, f) wherein said hinged operative connection includes a living hinge, g) said section having a stiffened corner between said living hinge and said tongue.

30. A mop and scrubber carrier comprising a) a mop with a handle, b) a scrubber carrier attachable to the mop, said carrier having two sections connected together at a stiffened corner, c) said carrier having two through holes of two different cross sectional areas, associated with one section to register with mop handle structure, c) said holes selectable to enable use of a different size mop handle structures, d) a scrubber attached to said carrier.

31. The apparatus of claim 30 wherein said carrier has weight between 1 oz. and 32 oz. and consists of plastic material.

* * * * *